United States Patent [19]

Blum et al.

[11] Patent Number: 4,785,888

[45] Date of Patent: Nov. 22, 1988

[54] DECORATIVE QUICK RESPONSE SPRINKLER

[75] Inventors: Leonard Blum, Montvale, N.J.; Falco Delmerico, Dobbs Ferry, N.Y.

[73] Assignee: The Reliable Automatic Sprinkler Co., Inc., Mount Vernon, N.Y.

[21] Appl. No.: 20,768

[22] Filed: Mar. 2, 1987

[51] Int. Cl.[4] ..... A62C 37/08

[52] U.S. Cl. ..... 169/39; 169/37; 169/42

[58] Field of Search ..... 169/37–42

[56] References Cited

U.S. PATENT DOCUMENTS

| | | | |
|---|---|---|---|
| Re. 8,833 | 8/1879 | Brown et al. . | |
| 489,342 | 1/1893 | Stratton . | |
| 551,162 | 12/1895 | Hill . | |
| 1,808,684 | 6/1931 | Rowley | 169/38 X |
| 1,892,724 | 1/1933 | Green . | |
| 1,898,897 | 2/1933 | Rowley . | |
| 1,919,235 | 7/1933 | Loepsinger . | |
| 1,925,007 | 8/1933 | Rowley . | |
| 2,166,277 | 7/1939 | Adams . | |
| 2,389,331 | 11/1945 | Tyden . | |
| 2,389,332 | 11/1945 | Tyden . | |
| 3,107,732 | 10/1963 | Bakos . | |
| 3,171,935 | 3/1965 | Gloeckler . | |
| 3,198,258 | 8/1965 | Werner . | |
| 3,216,506 | 11/1965 | Bakos . | |
| 3,291,216 | 12/1966 | Merrill . | |
| 3,633,676 | 1/1972 | Gloeckler | 169/40 |
| 3,638,733 | 2/1972 | De Rouville et al. . | |
| 4,015,665 | 4/1977 | Simons et al. . | |
| 4,105,076 | 8/1978 | Simons et al. . | |
| 4,139,062 | 2/1979 | Rago . | |
| 4,217,960 | 8/1980 | Miyazaki . | |
| 4,465,141 | 8/1984 | Johnson . | |
| 4,491,182 | 1/1985 | Pieczykolan . | |
| 4,596,289 | 6/1986 | Johnson | 169/37 |
| 4,618,001 | 10/1986 | Hoening | 169/38 X |
| 4,651,832 | 3/1987 | Kubo | 169/39 |
| 4,660,648 | 4/1987 | Zen | 169/38 |
| 4,664,198 | 5/1987 | Johnson | 169/38 |

FOREIGN PATENT DOCUMENTS

| | | | |
|---|---|---|---|
| 313 | of 1895 | United Kingdom | 169/40 |

*Primary Examiner*—Sherman D. Basinger
*Assistant Examiner*—Paul E. Salmon
*Attorney, Agent, or Firm*—Brumbaugh, Graves, Donohue & Raymond

[57] ABSTRACT

In the particular embodiments of the quick response sprinkler described in the specification, a sprinkler housing is sealed with a valve plug supported on a deflector which is movable between a closed position and an open position. A thermally responsive element supported from a first lever which engages the valve plug has a plunger supporting a second lever and a third lever maintains the spacing between the first and second levers. When the thermally responsive element is actuated by elevated temperature, the plunger moves away from the levers, permitting the levers to separate and releasing the entire valve-retaining mechanism from the sprinkler housing.

8 Claims, 2 Drawing Sheets

DECORATIVE QUICK RESPONSE SPRINKLER

BACKGROUND OF THE INVENTION

This invention relates to fire extinguishing sprinklers and, more particularly, to a new and improved sprinkler especially adapted to respond quickly to elevated temperature conditions indicative of a fire.

Sprinker systems are widely used for automatic fire protection in residential, commercial and public buildings. Heretofore, many sprinklers have been made with a frame structure for holding a valve member in the closed position which has a temperature-responsive element located within the frame structure. In order to expose the temperature-responsive element to ambient conditions, such sprinklers must be mounted so that the entire frame structure, with a deflector affixed at its outer end, projects downwardly from the ceiling. While some sprinklers have been designed with a temperature-sensitive element at their outer ends, the valve release mechanism in such sprinklers has been complex and expensive.

SUMMARY OF THE INVENTION

Accordingly, it is an object of the present invention to provide a new and improved sprinkler which is capable of responding rapidly to elevated ambient temperature conditions resulting from a fire while having a simple and compact structure.

This and other objects of the invention are attained by providing a sprinkler with a valve member which is normally retained in closed position by a valve-retaining assembly which is separable from the sprinkler upon activation of a temperature-responsive element. More particularly, the valve-retaining assembly includes a plurality of interlocking levers extending between the valve member and an inwardly projecting portion of the valve housing along with a thermally responsive element arranged to retain the interlocking levers in a condition to hold the valve member in its closed position. The thermally responsive element, which is linked to the lever that engages the valve member, includes an axially extending plunger received in a tubular housing with a heat detecting element at its outer end. In one embodiment, a first lever engages the thermally responsive element and the valve housing projection while a second lever enages the valve member and a valve housing projection while the third lever maintains the first and second levers in spaced-apart relation. In another embodiment, a first lever which engages the thermally responsive element is in engagement at its opposite end with a second lever member which engages the valve member, the third lever extending between the first and second levers to maintain them in a spaced-apart relation.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
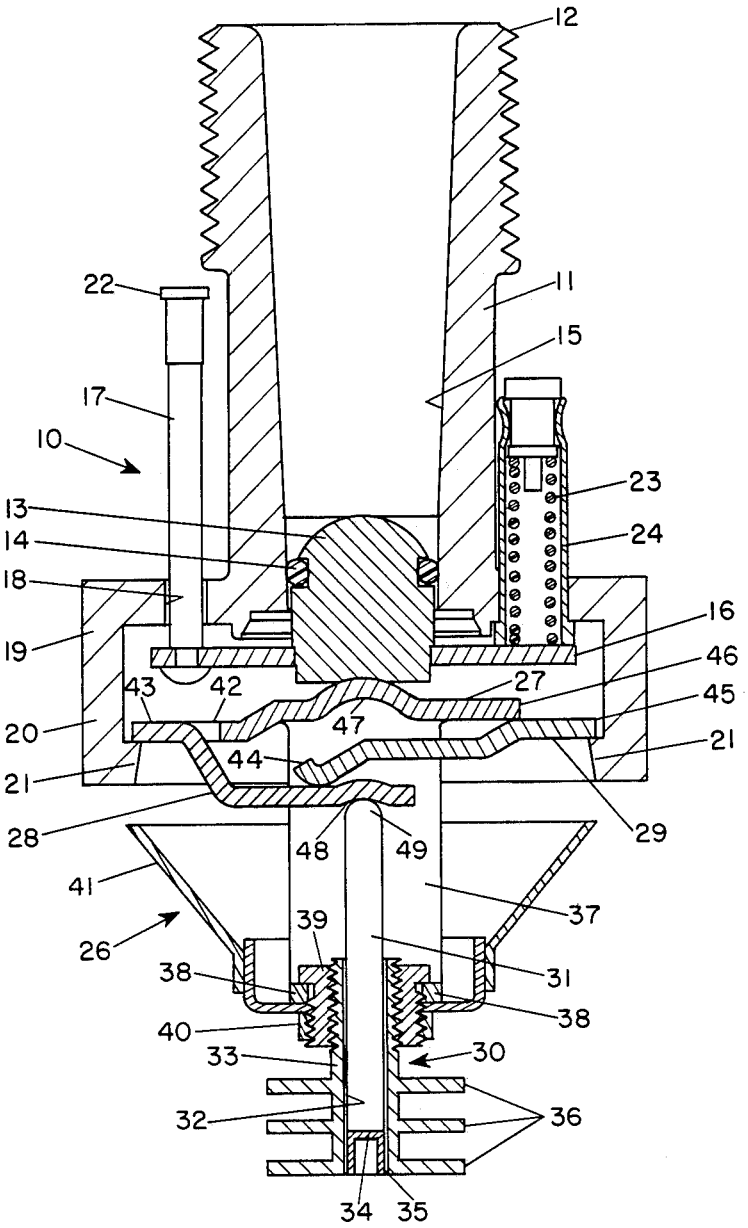
FIG. 1 is a longitudinal sectional view illustrating one form of quick response sprinkler arranged in accordance with the present invention.
Figure 2:
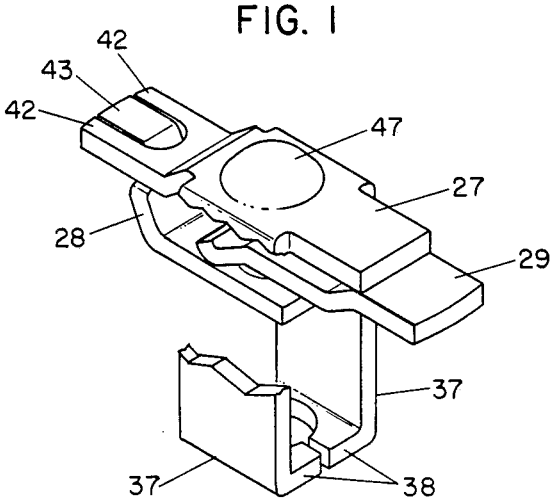
FIG. 2 is a fragmentary perspective view, partially broken away, showing the lever assembly for the sprinkler shown in FIG. 1.

In the typical embodiment of the invention shown in FIGS. 1 and 2, a sprinkler 10 includes a hollow body 11 threaded at one end 12 for attachment to a water supply pipe and normally closed the other end by a valve plug 13 provided with an 0-ring 14 which fits in sealing engagement with a bore 15 in the sprinkler body 11. At its outer end, the valve plug 13 carries a deflector 16 which serves to distribute the stream of water emerging from the bore 15 after the valve is opened. The deflector 16 and the attached valve plug 13 are supported by a plurality of guide pins 17, only one of which is illustrated in the drawings, for motion between the closed position of the valve as illustrated in FIG. 1 and an open position. The guide pins are distributed uniformly around the axis of the sprinkler, and each guide pin extends through a corresponding opening 18 in a flange 19 which extends outwardly from the open end of the sprinkler body 11 and terminates in an annular skirt 20 having an inwardly extending lip 21. The guide pins are formed with an enlarged head 22 to prevent them from passing through the openings 18.

A compression spring 23, enclosed in a spring housing 24 mounted in the flange 19, urges the deflector 16, along with the valve plug 13, in the downward direction as shown in the drawing, tending to open the valve. This assists the water pressure within the valve housing in overcoming any frictional resistance when the valve is activated.

In order to releasably retain the valve plug 13 in the closed position, a separable valve retaining assembly 26 is provided. The retaining assembly includes three interlocking levers 27, 28 and 29 and a thermally responsive unit 30 having a plunger 31 held in axially fixed position in the bore 32 of a sleeve member 33 by a plug 34. A solder bond 35 between the plug 34 and the bore 32 of the sleeve member normally retains the plug in fixed position in the sleeve but is designed to melt at a predetermined temperature to permit the plug to be pushed downwardly as viewed by FIG. 1 by the plunger 31. The sleeve 33, which has three disc-shaped heat detecting fins 36 at its lower end, is supported from the uppermost lever 27, which engages the valve plug 13, by two arms 37, only one of which is shown in FIG. 1. As been seen in FIG. 2, the arms 37 are bent inwardly toward each other at their lower ends to provide supporting projections 38 formed to provide a central opening to receive the sleeve 33.

As shown in the sectional view of FIG. 1, the sleeve 33 is threaded at its upper end and receives a threaded nut 39 which engages the upper surfaces of the projections 38. The nut 39 is also threaded on its exterior surface and receives a threaded ring 40 which clamps a conical escutcheon 41 against the lower surfaces of the projections 38 so as to conceal the lower portion of the valve housing 11.

In the embodiment of the invention shown in FIGS. 1 and 2, the lever 27 which engages the valve plug 13 has a bifurcated end, providing two legs 42 which rest on the projection 21, and the lever 28 which is engaged by the plunger 31 has a reduced width end section 43 extending between the legs 42 to rest on the projection 21. In order to maintain the spaced relation between the levers 27 and 28 so as to hold the valve plug 13 in closed position when the thermally responsive element 30 has not been actuated, the lever 29 has one end 44 engaging the top surface of the lever 28 adjacent to the axis of the retaining assembly and its other end 45 engaging the projection 21 o the opposite side from the ends 42 and 43 of the levers 27 and 28, and the oposite end 46 of the the lever 27 engages the upper surface of the lever 29 at a location spaced from the lip 21.

To assure smooth action when the retaining assembly is actuated and the levers are permitted to move with respect to the valve plug 13 and the plunger 31, the upper lever 27 has a rounded projection 47 where it abuts the lower surface of the valve plug 13, which is correspondingly shaped. Similarly, the lower surface of the lever 28 is formed with a dimple 48 where it is engaged by the rounded upper end 49 of the plunger 31.

When the retaining assembly 26 is assembled in the configuration illustrated in FIG. 1, the thermally responsive element 30 is threaded into the nut 39 to force the levers 27, 28 and 29 into the interlocking valve-retaining position with sufficient force so that a downward pressure is applied to the plug 34. The downward force is not sufficient to cause cold flow in the solder 35 but serves to accelerate release of the plug when the solder 35 melts. In operation, therefore, when the temperature in the vicinity of the detecting fins 36 reaches the predetermined melting point of the solder 35, the solder melts promptly and the downward force of the plunger 31 ejects the plug from the bore 32 quickly. When this occurs, the end of the lever 28 which engages the plunger follows the plunger downwardly, pivoting about the projection 21 which supports the end 43 and permitting the end 44 of the lever 29 to move downwardly, causing that lever to pivot about the end 45 supported from the projection 21.

As the inner ends of the levers 28 and 29 move downwardly, the end 44 of the lever 29 engages the dimple 48 of the lever 28, preventing relative lateral motion and causing the opposite ends 43 and 45 to be withdrawn from the edges of the projection 21. As soon as that happens, the end 46 of the upper lever 27 moves downwardly so that the opposite end 42 pivots about the projection 21, causing the entire retaining assembly to be thrown clear of the open end of the valve housing and permitting the valve plug 13 and deflector 16 to descend until enlarged ends 22 of the pins 17 hold the deflector in a position spaced below the lower end of the valve housing. As a result, water flowing through the passage 15 of the value housing strikes the valve plug 13 and the deflector 16 so that it is distributed in a uniform manner over the area beneath the valve.

Figure 3:
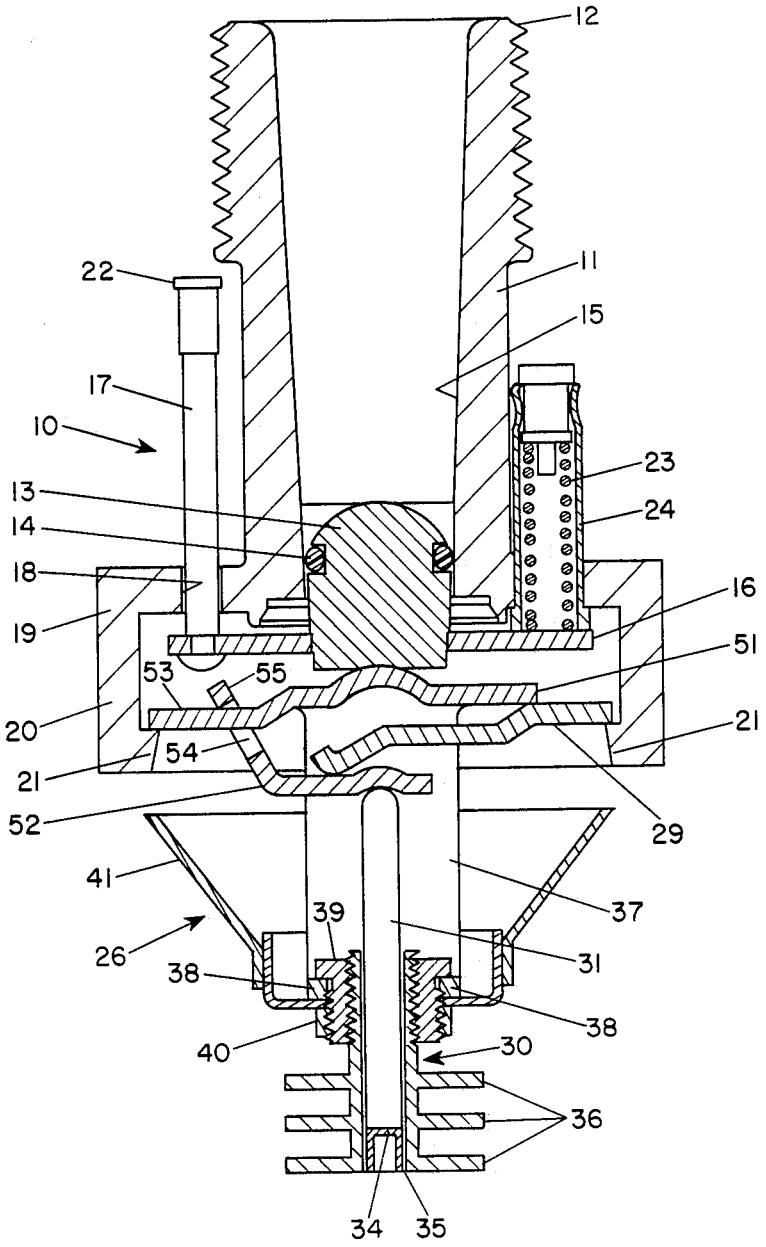
FIG. 3 is a longitudinal sectional view of another representative embodiment of the invention.

Except for the arrangement of the interlocking levers, the sprinkler shown in FIG. 3 is identical to that illustrated in FIGS. 1 and 2 and corresponding reference numerals are used to identify the similar parts. In this case, the upper lever designated 51 and the lower lever designated 52 have different shapes than the corresponding levers 27 and 28 of FIG. 1. The upper lever 51 has a narrow end 53 which extends through an aperture 54 in the lower lever 52 so that the end 55 of the lever 52 rests on the upper surface of the lever 51 at a point spaced from the housing projection 21 on which the end 53 of the lever 51 is supported. With this arrangement, the length of the pivoting motion required for the lever 52 to be free of the plunger 31 is reduced, resulting in a faster action when the sprinkler is actuated.

Although the invention has been described herein with reference to specific embodiments, many modifications and variations therein will readily occur to those skilled in the art. Accordingly, all such variations and modifications are included within the intended scope of the invention as described by the claims.

We claim:

1. A quick response sprinkler comprising a valve housing a valve bore having an axis and an open end adapted to supply fire extinguishing liquid, a valve sealing element adapted to seal the open end of the bore in the valve housing, a deflector supporting the valve sealing element and movable between a closed position in which the valve sealing element seals the bore of the valve housing and an open position in which the fire extinguishing liquid emerging from the valve bore is distributed over a large area by the deflector, projection means formed in the valve housing extending transversely to the axis of the valve bore, and separable valve-retaining means normally engaging the projection means and retaining the valve sealing means in position to seal the valve bore and responsive to an elevated temperature condition to be released from the projection means and separated completely from the valve housing to permit the valve sealing means to open the valve, the valve-retaining means comprising thermally responsive means positioned substantially coaxially with the valve bore and spaced form the deflector and responsive to an elevated temperature condition to move away from the deflector, first lever means engaging the thermally responsive means, second lever means laterally spaced from the first lever means engaging the valve sealing means and third lever means engaging the projection means and interposed between the first and second lever means to maintain them in spaced-apart relation and one of the first and second lever means also engaging the projection means when the thermally responsive means is held in spaced-apart relation to the valve sealing means and being releasable from the projection means when the thermally responsive means moves away from the valve sealing means.

2. A sprinkler according to claim 1 including support means extending between the second lever means and the thermally responsive means for supporting the thermally responsive means in spaced-apart relation from the valve sealing means.

3. A sprinkler according to claim 1 wherein the first and second lever means engage the projection means at adjacent location and the third lever means engages the projection means at a location diametrically opposed to the locations of engagement of the first and second lever means with the projection means.

4. A sprinkler according to claim 1 wherein the second and third lever means engage the projection means at locations diametrically opposed to each other with respect to the axis of the valve bore and the first lever means engages the second lever means at a location spaced from the projection means.

5. A quick response sprinkler comprising a valve housing having a valve bore having an axis and an open end adapted to supply fire extinguishing liquid, a valve sealing element adapted to seal the open end of the bore in the valve housing, a deflector supporting the valve sealing element and movable between a closed position in which the valve sealing element seals the bore of the valve housing and an open position in which the fire extinguishing liquid emerging from the valve bore is distributed over a large area by the deflector, projection means formed in the valve housing extending transversely to the axis of the valve bore, separable valve-retaining means normally engaging the projection means and retaining the valve sealing means in position to seal the valve bore and responsive to an elevated temperature condition to be released from the projection means and separated completely from the valve housing to permit the valve sealing means to open the valve, the valve-retaining means comprising thermally responsive means spaced from the deflector and responsive to an elevated temperature condition to move away from the deflector, first lever means engaging the thermally responsive means, second lever means engaging the valve sealing means and third lever means engaging the first and second lever means to maintain them in spaced-apart relation, at least two of the first, second and third lever means engaging the projection means when the thermally responsive means is held in spaced-apart relation to the valve sealing means and being releasable from the projection means when the thermally responsive means moves away from the valve sealing means and escutcheon means supported from the thermally responsive means and extending therefrom so as to conceal all of the lever means.

6. A quick response sprinkler comprising a valve housing having a valve bore having an axial and an open end adapted to supply fire extinguishing liquid, a valve sealing element adapted to seal the open end of the bore in the valve housing, a deflector supporting the valve sealing element and movable between a closed position in which the valve sealing element seals the bore of the valve housing and an open position in which the fire extinguishing liquid emerging from the valve bore is distributed over a larger area by the deflector, projection means formed in the valve housing extending transversely to the axis of the valve bore, and separable valve-retaining means normally engaging the projection means and retaining the valve sealing means in position to seal the valve bore and responsive to an elevated temperature condition to be released from the projection means and separated completely from the valve housing to permit the valve sealing means to open the valve, the valve-retaining means comprising thermally responsive means spaced from the deflector and responsive to an elevated temperature condition to move away from the deflector, first lever means engaging the thermally responsive means, second lever means engaging the valve sealing means and third lever means engaging the first and second lever means to maintain them in spaced-apart relation, at least two of the first, second and third lever means engaging the projection means when the thermally responsive means is held in spaced-apart relation to the valve sealing means and being releasable from the projection means when the thermally responsive means moves away from the valve sealing means, wherein the thermally responsive means includes a sleeve extending coaxially with respect to the bore of the valve housing, a plunger having an end position within the sleeve, plug means disposed in the sleeve adjacent to the end of the plunger, and means forming a bond between the plug means and the sleeve and responsive to a selected temperature condition to melt and release the bond between the plug means and the sleeve.

7. A quick response sprinkler according to claim 6 wherein the sleeve is provided with a plurality of spaced fins extending outwardly from the sleeve.

8. A quick response sprinkler according to claim 6 wherein the sleeve is provided with a plurality of spaced fins extending outwardly from the sleeve.

* * * * *

UNITED STATES PATENT AND TRADEMARK OFFICE

CERTIFICATE OF CORRECTION

PATENT NO. : 4,785,888

DATED : November 22, 1988

INVENTOR(S) : Leonard Blum et al.

It is certified that error appears in the above-identified patent and that said Letters Patent is hereby corrected as shown below:

Column 4, line 28: The word "form" should read --from--; line 49: The word "location" should read --locations--.

Column 5, line 34: The word "larger" should read --large--.

Signed and Sealed this

Twenty-fifth Day of April, 1989

*Attest:*

*Attesting Officer*

DONALD J. QUIGG

*Commissioner of Patents and Trademarks*